United States Patent [19]

Osting et al.

[11] Patent Number: 4,784,279

[45] Date of Patent: Nov. 15, 1988

[54] PRESENT INVENTION RELATES TO IMPROVEMENTS IN TAMPER-PROOF CLOSURES

[75] Inventors: Richard C. Osting, Phoenixville; William A. Conard, Harleysville, both of Pa.

[73] Assignee: The West Company, Phoenixville, Pa.

[21] Appl. No.: 80,409

[22] Filed: Jul. 31, 1987

[51] Int. Cl.[4] ..... B65D 51/00

[52] U.S. Cl. ..... 215/251; 215/249; 215/254

[58] Field of Search ..... 215/249, 251, 253, 254

[56] References Cited

U.S. PATENT DOCUMENTS

| | | | |
|---|---|---|---|
| 3,480,171 | 11/1969 | Rohde | 215/251 |
| 3,823,841 | 7/1974 | Lovejoy | 215/251 |
| 4,244,478 | 1/1981 | Handman | 215/251 |
| 4,471,879 | 9/1984 | Conner et al. | 215/249 |

FOREIGN PATENT DOCUMENTS

| | | | |
|---|---|---|---|
| 1288197 | 8/1962 | France | 215/254 |

*Primary Examiner*—Stephen Marcus
*Assistant Examiner*—Nova Stucker
*Attorney, Agent, or Firm*—Eugene E. Renz, Jr.

[57] ABSTRACT

A tamper-proof seal for a container having at least one circumferentially extending flange adjacent the discharge opening therein comprising an annular top and a circumferentially extending skirt depending from the top adapted to be crimped at its lower terminal edge to engage under the flange to hold it on the container. A pull ring connects to the annular portion by a throat portion and partial score lines extend across the annular top portion on either side of the pull ring and define a plurality of circumferentially spaced score lines extending from the lower edge of the skirt upwardly in an axial direction to a point closely adjacent the juncture of the skirt and annular top portion. The axial score lines are spaced closely about the skirt.

5 Claims, 1 Drawing Sheet

FIG.2
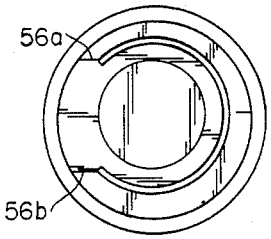
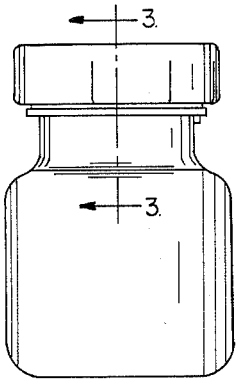
FIG.1
FIG. 4
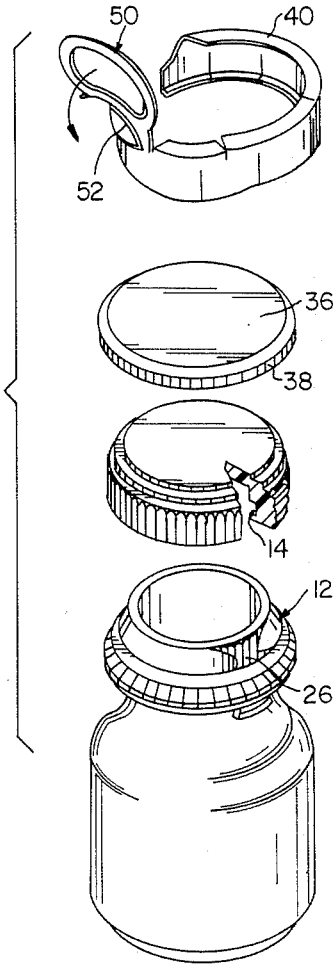
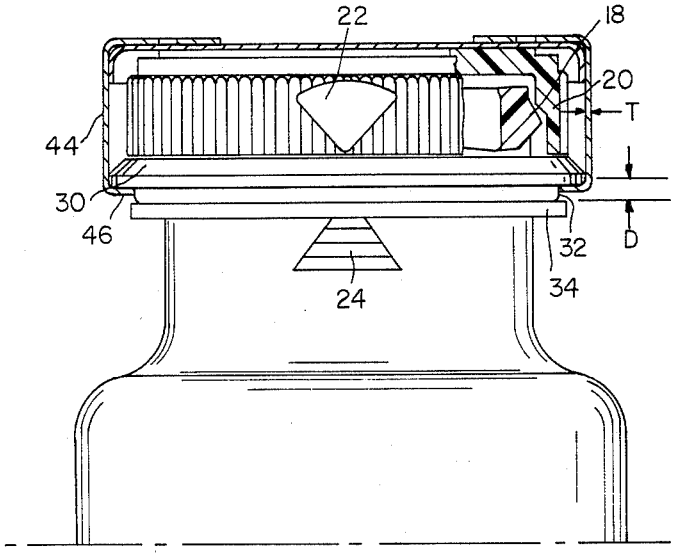
FIG. 3
FIG.5
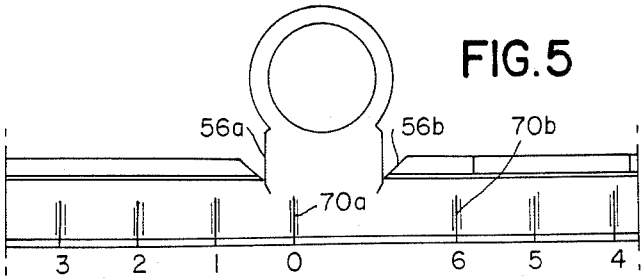

PRESENT INVENTION RELATES TO IMPROVEMENTS IN TAMPER-PROOF CLOSURES

FIELD OF THE INVENTION

The present invention relates to improvements in tamper-proof closures.

BACKGROUND OF THE INVENTION

Tamper-proof container closures are not new per se. Prior closures generally of the type to which the present invention relates are shown in the patents listed below.

| Inventor | Patent No. | Issue Date |
|---|---|---|
| Underwood | 2,544,969 | 03/13/51 |
| Glensky | 2,705,085 | 03/29/55 |
| Glensky | 3,439,825 | 04/22/69 |
| Rohde | 3,480,171 | 11/25/69 |

These patents show prior closures or seals made of aluminum which are adapted to be assembled over the bottle finish by crimping a lower edge of the aluminum seal under a peripheral flange or bead on the bottle finish below the discharge opening therein and incorporate some type of actuating tab and scoring to facilitate removal of the seal when it is desired to gain access to the contents of the container. These prior closures while generally effective for the purposes intended, nevertheless, have some disadvantages or drawbacks particularly in so far as the tamper-proof characteristics.

SUMMARY OF THE INVENTION

With the foregoing in mind, it is an object of the present invention to provide improvements in aluminum seals of the above type for use on pharmaceuticals to improve their tamper-proof capabilities. To this end, the aluminum seal comprises and annular top portion having a circumferentially extending depending skirt which terminates at its lower end in a crimped in edge which engages under a peripherally extending flange on the bottle finish. Located within the annular top is a pull ring connected to the annular top by a pair of spaced parallel score lines which terminate slightly below the juncture of the annular top portion and skirt. The annular top has a series of circumferentially spaced score lines extending inwardly from the inner edge to a point slightly below the juncture of the annular top and skirt portion. The skirt has a plurality of circumferentially spaced closely adjacent score lines extending from the lower edge axially upwardly to a point closely adjacent the juncture of the skirt and top. These closures are particularly adapted for use on containers for pharmaceutical products such as aspirin. It has been found that elderly and incapacitated people have difficulty in opening currently available tamper-resistant packages and experience less difficulty in removing the tamper-proof seal of the present invention. The series of elongated closely spaced score lines emanating from the lower edge of the seal ease the removal process and also are important in providing indicia that the closure has been perhaps opened once. The scoring pattern and particularly the scoring on the skirt portion of the seal is designed to produce easy removal of the seal in one piece by simply actuating the pull ring in a rotary path. Additionally, the container is provided with a recessed channel to receive the lower edge of the skirt which makes it difficult to pry open the seal at this location. The hemmed edge arrangement also eliminates the risk of cutting fingers from sharp aluminum edges while the closure is being opened. Further, the depth of scoring and minimum width of bridges are such that removal of the seal of the present invention is extremely easy.

BRIEF DESCRIPTION OF THE DRAWINGS

These and other objects of the present invention and the various features and details of the operation and construction thereof are hereinafter more fully set forth with reference to the accompanying drawing, wherein:

FIG. 1 is a side elevational view of a container closure assembly in accordance with the present invention;

FIG. 2 is a top plan view of the assembly shown in FIG. 1;

FIG. 3 is an enlarged side elevational view partly in section to show the details of the closure more clearly;

FIG. 4 is an exploded perspective view of the elements comprising the container-closure assembly of the present invention; and FIG. 5 is a fragmentary developed view of the aluminum seal portion of the closure.

DETAILED DESCRIPTION OF THE PREFERRED EMBODIMENT

Referring now to the drawings and particularly to FIGS. 3 and 4 thereof, there is shown a container closure assembly in accordance with the present invention. The container which is generally designated by the numeral 10 in the present instance has a finish 12 designed to accommodate a snap cap 12 of the type illustrated having a series of circumferentially spaced inwardly directly lugs 14 which engage under a rib 16 on the container which is tapered as at 18 to facilitate applications of the cap 12 simply by pressing it axially inwardy until the radially inwardly directed lugs 14 on the lower edge of the skirt 20 engage under the bead 16 on the container finish. Indicia means 22 on the cap which aligns with an indicator 24 on the container is provided so that when they are aligned the snap cap can be readily removed from the container. In this position, one of the lugs 14 on the skirt of the cap registers with an opening 26 in the rib 16 on the container to release the cap easily. Note that the cap normally seats on an enlarged circumferentially extending flange 30 spaced axially below the rib 16. In the present instance, the container finish also includes a circumferentially extending pocket or recess 32 defined by still another readily outwardly directed flange 34 below the flange 30 within which the lower edge of the skirt of aluminum overseal nests in the manner illustrated in FIG. 3.

The closure system also includes a disk member 36 which overlies the top of the cap and has a short downwardly depending circumferentially extending lip 38.

Considering now the specific details and construction of the aluminum seal 40, the seal as illustrated has an annular top portion 42 and a circumferentially extending depending skirt 44 which terminates in an inwardly directly locking flange 46 at its lower terminal edge which engages in the assembled relation in the pocket 32 defined by the spaced flanges 30 and 34 on the container finish. The pocket 32 is of an axial depth D slightly greater than the thickness T of the skirt portion 44 which allows sufficient clearance for crimping the lower edge of the skirt 44 to the assembled position and inhibits use of an instrument to pry the skirt for tampering purposes. This is a tamper-proof feature which makes it difficult to successfully pry the lower edge of the seal to permit removal and re-seal without either damaging the lower edge to a point where it provides visual indicia that it has been tampered with and/or breaks the scoring in the skirt as described in more detail below. The annular top terminates in a central opening 48 and disposed within that opening is a pull ring 50 formed integrally and having a throat portion 52 connected by parallel score lines 56 to the skirt in the manner illustrated. There are score lines 60 in the annular top 42 at locations spaced away from the pull ring 50 which extend across the annular top and slightly over the juncture 60 of the top and skirt portion. There are also a plurality of axially directed relatively closely spaced score lines 70 about the periphery of the skirt 64 which extend upwardly from the lower edge of the skirt 64 to a point just short of the juncture 60 of the skirt and top portion as illustrated. These score lines 70 are preferably spaced about the periphery of the skirt at least no greater than 60 degrees between adjacent score lines 70.

Another feature of the present invention resides in the pattern of the scoring 70 in the region of the pull ring 50 to facilitate ease of removal of the entire seal in one piece by a simple counterclockwise movement during the removal process. More specifically, there is one score line designated **70*a* adjacent the scoring 56*a* to the left of the pull ring 50 as viewed in FIG. 5 and the next adjacent score line in the skirt 70*b* is remote from the companion score line 56*b* as best illustrated in FIG. 5. By this arrangement, when the pull ring 50 is actuated upwardly the seal will fracture along the scoring lines 56*a* and 70*a* in the manner shown in FIG. 4 and the remainder of the ring will stay intact as one piece during the removal process. Thus, the scoring configuration produces a consistent repeatable removable direction. Even though the preferred disposition of the score lines 70** is one where they are uniformly spaced, the spacing may be variable so long as the number of scores is sufficient for a given seal to result in ease of removal and maintain a tamper-evident feature as discussed above.

The parts comprising the closure are easy and economical to assemble by automatic equipment. The containers are filled with a product such as aspirin in the usual manner by automatic filling equipment and thereafter the snap cap 12 is simply pressed in place, the disk like liner 36 then is positioned over the top of the cap. Thereafter, the aluminum seal 40 is placed over the assemby as described and the lower edge of the skirt simply spun or crimped under the larger of the two flanges 30 and 34 so that the edge engages in the pocket 32 in the manner illustrated in FIG. 3. Now when it is desired to access the contents of the container, the pull ring 50 is simply raised by the user and pulled in the direction indicated in FIG. 4 which effects fracturing of the score lines on either side of the tab. The seal fractures along the score lines **56*a* and 70*a* during removal by reason of their close association which is desirable and leaves the remainder of the seal in tact as one piece. The entire seal may then be removed by simply peeling it in a counter clockwise direction. It is noted that the multiplicity of score lines 70 in the skirt facilitate removal action. It is also noted that these scorings 70** fracture rather readily and accordingly, provide a multiplicity of indicia means should someone remove the seal to tamper with the contents and then replace the seal to make it appear as though the seal had not been disturbed. Likewise the nesting of the lower edge in the pocket of the container ensures against utilization of a tool to pry the lower edge so that the entire seal can be removed for tamper purposes.

While a particular embodiment of the invention has been illustrated and described herein, it is not intended to limit the invention and changes and modifications may be made therein within the scope of the following claims. For example,

What is claimed is:

1. A combination of a container having a discharge opening and a pair of circumferentially extending axially spaced flanges defining a recess on the exterior of the container adjacent the discharge opening, a cap detachably secured over the discharge opening and a seal normally engaging over the cap comprising:

an annular top, a circumferentially extending skirt depending from the top adapted to be crimped at its lower terminal edge to engage under one of said flanges to hold it on the container, a pull ring connected to the annular portion by a throat portion and partial score lines extending across the annular top portion and means defining a plurality of circumferentially spaced score lines extending from the lower edge of the skirt upwardly in an axial direction to a point closely adjacent the juncture of the skirt and annular top portion, said scores lines being spaced about said skirt at least at 60° intervals or less.

2. A tamper-proof seal for a container having at least one circumferentially extending flange adjacent the discharge opening therein comprising:

an annular top, a circumferentially extending skirt depending from the top adapted to be crimped at its lower terminal edge to engage under a flange to hold it on a container, a pull ring connected to the annular portion by a throat portion and partial score lines extending across the annular top portion on either side of said pull ring and means defining a plurality of circumferentially spaced stores lines extending from the lower edge of the skirt upwardly in an axial direction to a point closely adjacent the juncture of the skirt and annular top portion, adjacent score lines in the skirt being spaced apart at intervals of about 60°.

3. A tamper-proof seal as claim in claim 2, wherein one of said axial score lines is located adjacent one of said score lines in the annular top portion and the other score line in the annular top portion is located more remote from an axial score line.

4. A tamper-proof seal for a container having at least one circumferentially extending flange adjacent the discharge opening therein comprising:

an annular top, a circumferentially extending skirt depending from the top adapted to be crimped at its lower terminal edge to engage under a flange to hold it on a container, a pull ring connected to the annular portion by a throat portion and partial score lines extending across the annular top portion on either side of said throat portion and means defining a plurality of circumferentially spaced axial score lines having inner ends, said score lines extending from the lower edge of the skirt upwardly in an axial direction so that their inner ends are directed at a point closely adjacent the juncture of the skirt and annular top portion, said axial score lines being spaced closely around the entire periphery of the skirt, one of said axial score lines havings its inner end closely adjacent one of said throat portion partial score lines and the other of said throat portion partial score lines being remote from an axial score line whereby upon actuation of said pull ring, the seal completely separates along said one throat portion partial score line and said one axial score line and the ring may be removed by a peeling action.

5. A tamper-proof seal for a container having at least one circumferentially extending flange adjacent the discharge opening therein comprising:

an annular top, a circumferentially extending skirt depending from the top adapted to be crimped at its lower terminal edge to engage under a flange to hold it on a container, a pull ring connected to the annular portion by a throat portion and partial score lines extending across the annular top portion on either side of said throat portion and means defining a plurality of circumferentially spaced axial score lines extending from the lower edge of the skirt upwardly in an axial direction to a point closely adjacent the juncture of the skirt and annular top portion, said axial score lines being spaced closely around the entire periphery of the skirt, and having at least one score line located in each quadrant of said skirt.

* * * * *

UNITED STATES PATENT AND TRADEMARK OFFICE

CERTIFICATE OF CORRECTION

PATENT NO. : 4,784,279

DATED : November 15, 1988

INVENTOR(S) : Osting et al

It is certified that error appears in the above-identified patent and that said Letters Patent is hereby corrected as shown below:

TITLE OF INVENTION SHOULD READ

-- RING PULL TAMPER-PROOF CLOSURE --.

Signed and Sealed this

Eleventh Day of April, 1989

*Attest:*

*Attesting Officer*

DONALD J. QUIGG

*Commissioner of Patents and Trademarks*